United States Patent [19]

Hollins

[11] 4,050,427

[45] Sept. 27, 1977

[54] CARBURETOR AUTOMATIC CHOKE CONSTRUCTION

[75] Inventor: James E. Hollins, Inkster, Mich.

[73] Assignee: Ford Motor Company, Dearborn, Mich.

[21] Appl. No.: 194,935

[22] Filed: Nov. 2, 1971

[51] Int. Cl.[2] ..... F02D 11/08; F02M 1/10; F02M 23/04

[52] U.S. Cl. ..... 123/119 F; 219/207; 261/39 E; 261/39 A; 261/39 R

[58] Field of Search ..... 261/39 A, 39 B, 39 C, 261/39 R, 39 E; 123/119 F; 219/202

[56] References Cited

U.S. PATENT DOCUMENTS

| | | | |
|---|---|---|---|
| 2,937,635 | 5/1960 | Carlson et al. | 123/119 F |
| 2,962,014 | 11/1960 | Durler | 123/119 F |
| 2,965,082 | 12/1960 | Carlson | 123/119 F |
| 3,158,322 | 11/1964 | Furbacher | 123/119 F X |
| 3,179,098 | 4/1965 | Highley et al. | 123/119 F |
| 3,185,453 | 5/1965 | Mennesson | 261/39 R |
| 3,198,185 | 8/1965 | Nastas | 123/119 F |
| 3,212,486 | 10/1965 | Lorge | 123/119 F |
| 3,230,945 | 1/1966 | Goodyear | 123/119 F |
| 3,237,927 | 3/1966 | Bickhaus | 123/119 F X |
| 3,291,461 | 12/1966 | Pope | 123/119 F X |
| 3,423,569 | 1/1969 | Cappell et al. | 123/119 F X |
| 3,699,937 | 10/1972 | DePetris | 123/119 F |

*Primary Examiner*—Wendell E. Burns
*Attorney, Agent, or Firm*—Robert E. McCollum; Keith L. Zerschling

[57] ABSTRACT

The carburetor has a conventional automatic choke construction heating a bimetallic coil by engine exhaust stove heat to slowly open the choke valve during cold weather starts; supplemental heat is provided by an electrically controlled positive temperature coefficient heater device operable above a predetermined ambient temperature to move the choke valve open faster, to reduce emissions.

4 Claims, 3 Drawing Figures

CARBURETOR AUTOMATIC CHOKE CONSTRUCTION

Figure 1:
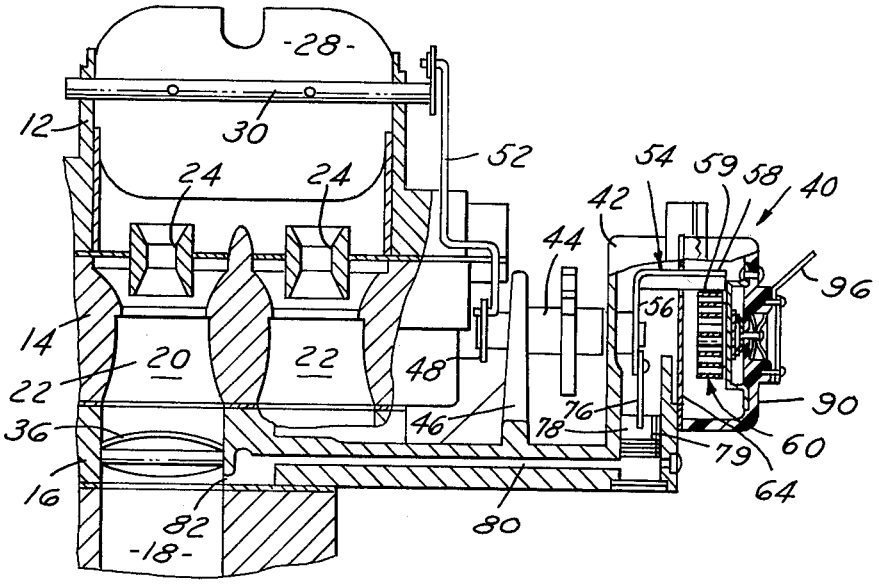

This invention relates, in general, to a carburetor for a motor vehicle engine. More particularly, it relates to an automatic choke to control the idle speed of the engine during cold weather starts, while at the same time minimizing the output of undesirable emissions.

As ambient temperature drops, friction within the engine and the viscosity of the lubricants increase significantly. Therefore, at low temperatures, the speeds as which an engine normally would idle must be increased to prevent stalling. Accordingly, a choke mechanism is generally provided to lessen the air intake during cold starting and preengine warmup to insure a richer mixture.

Generally, the choke apparatus includes a coiled thermostatic spring that operatively rotates the choke valve towards a closed or nearly shut position with decreasing temperatures, and progressively opens it as the temperature returns towards a chosen level. A manifold suction responsive device generally cracks open the choke a predetermined amount when the engine starts. The choke action provides a rich mixture so that sufficient fuel can be vaporized to permit smooth starting and running of the engine.

The above construction, while generally satisfactory, is a compromise between good cold weather running conditions on one hand and low emission outputs on the other hand. The richer than normal mixture existing during the choking operation may result in higher emission output such as, for example, CO.

It is an object of this invention to provide an automatic choke construction that will provide good cold weather characteristics and yet reduce to a minimum the output of undesirable smog producing elements.

It is another object of the invention to provide an automatic choke construction that provides a leaner than conventional air/fuel mixture immediately after the engine starts by opening the choke valve faster than would be by conventional choke systems.

It is also an object of the invention to provide an automatic choke construction consisting of a positive temperature coefficient heater element operable above a predetermined ambient temperature to shorten the length of time required for the normal operation of an automatic choke.

Another object of the invention is to provide an automatic choke construction including a thermostatically controlled bimetal spring normally urging the choke valve closed with decreasing ambient temperature changes and opposed by a suction operated motor device that initially cracks open the choke valve to a predetermined amount permitting running operation during cold weather; engine exhaust manifold heat being directed to spring coil to warm it; and, a supplemental heat source providing additional heat to the coil spring at ambient temperatures above a predetermined level to cause the closing force on the choke valve to be removed earlier than would be were the supplemental heat source not provided; the supplemental heat source consisting of a positive temperature coefficient semiconductor heater element whose internal resistance increases with increases in the heater internal temperature and decreases in current flow so as to be selflimited in temperature output thereby eliminating the need for a thermostatic circuit breaker to prevent bimetal coil distortion above predetermined temperature levels.

Figure 3:
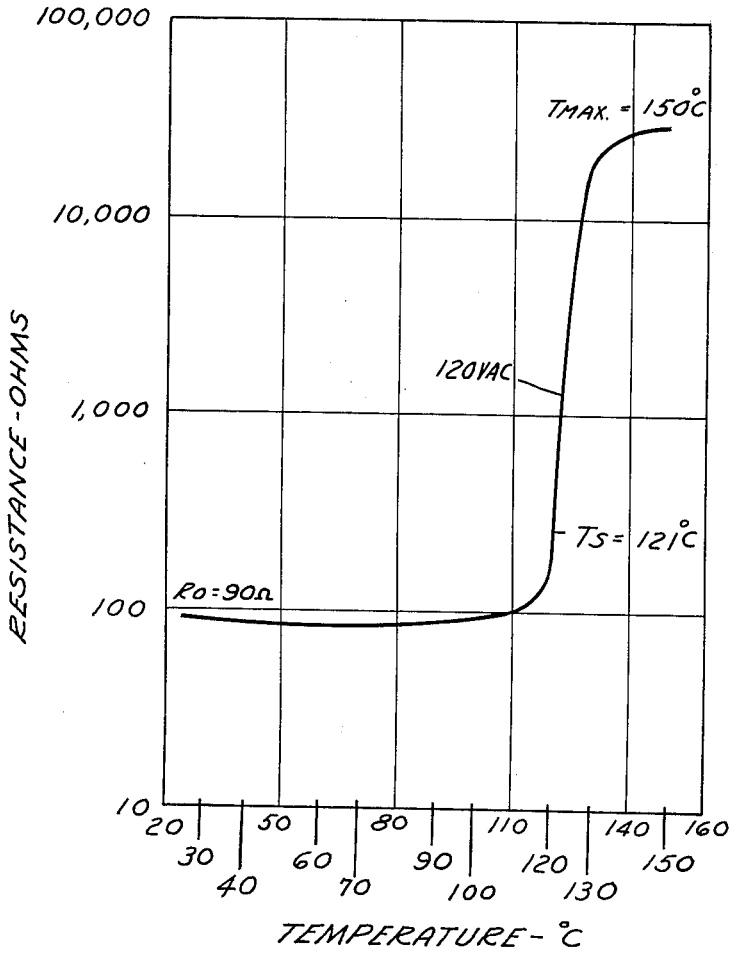
Figure 2:
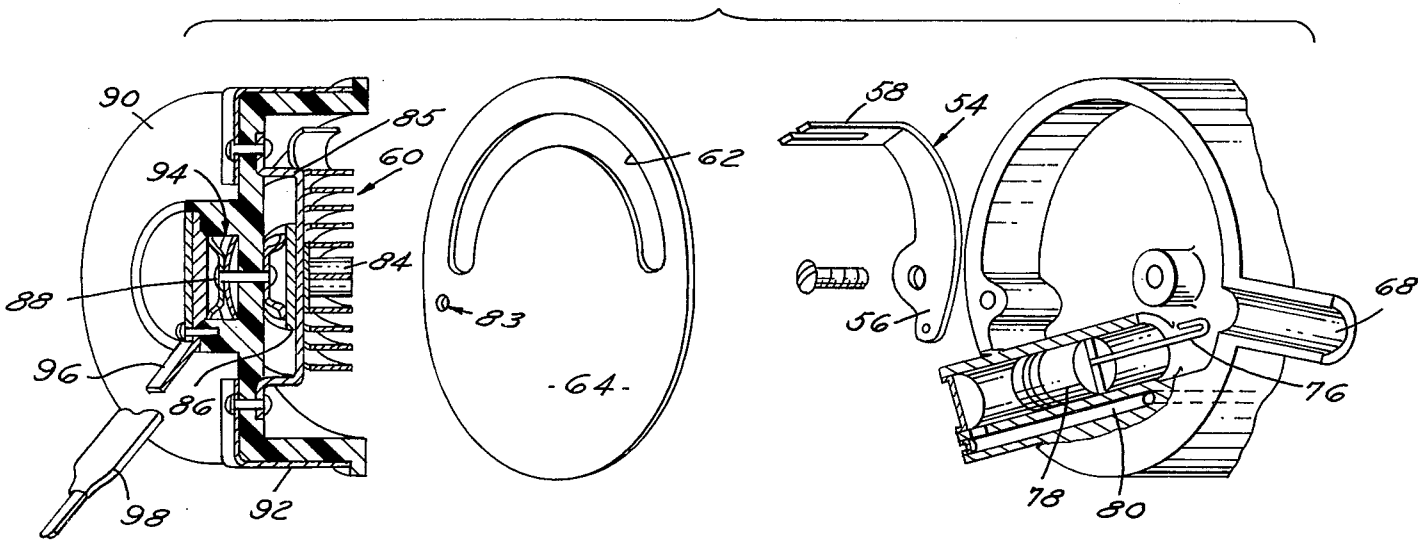

Other objects, features and advantages of the invention will become more apparent upon reference to the succeeding detailed description thereof, and to the drawings illustrating a preferred embodiment thereof; wherein FIG. 1 is a cross-sectional elevational view of a portion of a four-barrel carburetor embodying the invention;

FIG. 2 is a perspective view of the automatic choke of the invention, with parts in exploded position; and, FIG. 3 is a graph plotting the changes in internal resistance of the heater of this invention with changes in internal temperature.

FIG. 1 is obtained by passing a plane through approximately one-half of a known type of four-barrel, downdraft type carburetor. The portion of the carburetor shown includes an upper air horn section 12, an intermediate main body portion 14, and a throttle valve flange section 16. The three carburetor sections are secured together by suitable means, not shown, over an intake manifold indicated partially at 18 leading to the engine combustion chambers.

Main body portion 14 contains the usual air-fuel mixture induction passages 20 having fresh air intakes at the air horn ends, and connected to manifold 18 at the opposite ends. The passages are each formed with a main venturi section 22 containing a booster venturi 24 suitably mounted for cooperation therewith, by means not shown.

Air flow through passages 20 is controlled in part by a choke valve 28 unbalance mounted on a shaft 30 rotatably mounted on side portions of the carburetor air horn, as shown. Flow of fuel and air through each passage 20 is controlled by a conventional throttle valve 36 (only one shown) fixed to a shaft 38 rotatably mounted in flange portion 16. The throttle valves are rotated in a known manner by depression of the vehicle accelerator pedal, and move from an idle speed position essentially blocking flow through passage 20 to a wide open position essentially at right angles to the position shown.

The rotative position of choke valve 28 is controlled by a semiautomatically operating choke mechanism 40. The latter includes a hollow housing portion 42 that is formed as an extension of the carburetor throttle flange. The housing is apertured for supporting rotatably one end of a choke lever operating shaft 44, the opposite end being rotatably supported in a casting 46. A bracket or lever portion 48 is fixed on the left end portion of shaft 44 for mounting the end of a rod 52 that is pivoted to choke valve shaft 30. It will be clear that rotation of shaft 44 in either direction will correspondingly rotate choke valve 28 to open or close the carburetor air intake, as the case may be.

An essentially L-shaped thermostatic spring lever 54 has one leg 56 fixedly secured to the opposite or right-hand end portion of shaft 44. The other leg portion 58 of the lever is secured to the outer end 59 of a coiled bimetallic thermostatic spring element 60 through an arcuate slot 62 in an insulating gasket 64.

Leg 56 is also pivotally fixed to the rod 76 of a piston 78. The latter is movably mounted in a bore 79 in housing 42. The under surface of piston 78 is acted upon by vacuum in a passage 80 that is connected to carburetor main induction passages 20 by a port 82 located just slightly below throttle valve 36. Piston 78, therefore, is always subjected to any vacuum existing in the intake manifold passage portion 18.

The casing 42 is provided with a hot air passage 68 connected to an exhaust manifold heat stove, for example. The cylinder in which piston 78 slides is provided with bypass slots, not shown, in a known manner so that the vacuum acting on the piston will cause a flow of the hot air from passage 68 to passage 80. More specifically, hot air will flow into the area round the spring coil 60 through a hole 83 in gasket 64 and out through slot 62 to the bypass slots around piston 78.

As thus far described, the construction is conventional. It will be clear that the thermostatic spring element 60 will contract or expand as a function of the changes in ambient temperature conditions of the air entering tube 68; or, if there is no flow, the temperature of the air within chamber 74. Accordingly, changes in ambient temperature will rotate the spring lever 54 to rotate shaft 44 and choke valve 28 in one or the other directions as the case may be.

As is known, a cold weather start of a motor vehicle requires a richer mixture than a warmed engine start because considerably less fuel is vaporized. Therefore, the choke valve is shut or nearly shut to increase the pressure drop thereacross and draw in more fuel. Once the engine does start, however, then the choke valve should be opened slightly to lean the mixture to prevent engine flooding as a result of an excess of fuel.

The known choke mechanism described automatically accomplishes the action described. That is, on cold weather starts, the temperature of the air in chamber 74 will be low so that spring element 60 will contract and rotate shaft 44 and choke valve 28 to a closed or nearly closed position, as desired. Upon cranking the engine, vacuum in passage 80 will not be sufficient to move piston 78 to open the choke valve. Accordingly, the engine will be started with a rich mixture. As soon as the engine is running, high vacuum in passage 80 moves piston 78 downwardly and rotates shaft 44 a slight amount so that choke valve 28 is slightly opened so that less fuel is admitted to induction passage 20. Shortly thereafter, the exhaust manifold stove air in line 68 will become progressively warmer and cause choke element 60 to unwind slowly and rotate shaft 44 and choke valve 28 to a more open position. Further details of construction and operation are not given since they are known and believed to be unnecessary for an understanding of the invention.

As thus far described, the construction is conventional. Turning now to FIG. 2, it will be seen that the thermostatic spring coil 60 is centrally staked to a metal post 84. The post is formed as an integral part of a thin metal, aluminum, for example, disc 85 that is approximately the diameter of coil 60. The disk constitutes a heat sink or transfer member to evenly radiate heat to the coil from a heater element 86 to which it is secured.

Heater element 86 is a positive temperature coefficient (PTC) semiconductor in the shape of a flat ceramic disc. It is fixed on disc 85 and has a central spring-leg type current carrying contact lug 88 projecting through an insulated cover or choke cap 90. The heat sink disc is grounded through the cover to the cast housing by extensions and ground terminals 92.

Lug 88 is normally spaced from a contact fixed on a bimetallic thermal switch 94 that is sensitive to ambient temperture changes. The switch closes above 65°± F, for example, to engage the contacts and conduct current to the heater from a terminal 96 connected to a wire harness 98. The vehicle alternator could serve as a suitable source of electrical energy to the harness, when the vehicle is running.

Returning now to heater element 86 per se, it is a characteristic of the PTC heater that its internal resistance varies directly with the skin temperature of the element, from a predetermined switch point Ts. The change in the internal resistance is not a linear function of the elements' internal temperature but varies in the manner shown more clearly in FIG. 3. When the PTC heater 86 is electrically energized, as by applying line voltage to its terminals from the alternator when switch 94 closes, the Joule heat causes rapid self-heating of the PTC element. The heater resistance remains almost constant as it heats from room temperature. It increases as the PTC temperature nears the switching temperature Ts, or desired upper limit, at which point the resistance increases sharply, as shown. The electrical characteristics, of course, can be controlled by the chemical composition and process of making it.

It will be seen, therefore, that it is an inherent property of this semiconductor to obtain a very high impedance to current flow at high internal temperatures, and that the semiconductor has an ability to maintain a high maximum temperature. The need for a cut off thermostat to protect against distortion of the bimetallic coil 60, therefore, due to extreme temperature levels is thereby eliminated.

In this instance, therefore, the PTC device provides heat to coil 60 that is supplemental to that provided by the primary exhaust manifold hot air system. When the bimetal 94 closes and current passes through the PTC element, a change in the internal temperature is noticed. This heat generated is transferred by conduction to coil 60 through the post 84 and by radiation to the coil from the heat sink 85.

When the PTC internal temperature reaches the switching temperature Ts, say 180° F, as seen in FIG. 4, the internal resistance is so high that the current flow is very low and essentially cut off. It will be seen, therefore, that the heat input to the PTC element by the current flow then is essentially balanced by the heat loss by the PTC to the environment and to the bimetal post 84. Therefore, for all intents and purposes, the heat of the PTC remains at a constant level.

The overall operation is believed to be clear from the above description and the drawings, and therefore will not be repeated in detail. In brief, below an ambient temperature level of 65°± F, the bimetal switch contacts 94, 88 remain open, and the PTC heater remains deenergized. Therefore, the choke hot air system provides the only heat source for choking functions below 65° F. The bimetal coil 60 will unwind, therefore, only as a function of the increased heating by the hot air from passage 68.

Above 65° F, however, the conventional exhaust manifold stove heat system constitutes the primary heat source, while the energized PTC heater acts as the supplemental source to rapidly permit the opening of the choke valve by air flow faster than were it being controlled by the primary heat source alone. This leans the fuel/air mixture earlier than with conventional choke arrangements, and lowers undesirable emission outputs.

With the above described two phase choke construction, therefore, it will be seen that it is possible to provide a reliable and accurate short duration choking effect thereby minimizing vehicle exhaust emission without jeopardizing the cold weather choking function.

I claim:

1. An automatic choke system for use with a carburetor having an air/fuel induction passage and an unbalance mounted, air movable, choke valve mounted for variable movement across the passage to control air flow through the passage, thermostatic spring means operably connected to the choke valve urging the choke valve towards a closed position with a force increasing as a function of decreases in the temperature of the spring means from a predetermined level, and a self-limiting output temperature heater device located adjacent the spring means operable to transfer its heat output thereto up to its limit to reduce the choke valve closing force of the spring means and permit opening of the choke valve by air flow through the passage against it, including means rendering the heater device operable above a predetermined ambient temperature level to begin transferring its heat output to the spring means, and a heat sink secured to the heater device for uniformly radiating the heat of the heater device to the spring means.

2. A choke system as in claim 1, the heat sink comprising a thin metallic disc secured to the spring means mounting means between the heater device and spring means.

3. An automatic choke system for use with a carburetor having an air/fuel induction passage and an unbalance mounted, air movable, choke valve mounted for variable movement across the passage to control air flow through the passage, thermostatic spring means operably connected to the choke valve urging the choke valve towards a closed position with a force increasing as a function of decreases in the temperature of the spring means from a predetermined level, a positive temperature coefficient (PTC) heater device located adjacent the bimetallic spring means and operable above a predetermined ambient temperature level to transfer its heat output to the spring means to reduce choke valve closing force of the spring means and permit opening of the choke valve by air flow through the passage against it, the internal impedance off the PTC device increasing with increases in internal temperature of the PTC device so as to above a predetermined PTC temperature level minimize current flow and heat output, and a heat sink secured to the PTC device for uniformly radiating the heat of the PTC device to the spring means.

4. A choke system as in claim 3, the heat sink comprising a thin metallic disc secured to the spring means mounting means between the PTC device and spring means.

* * * * *